United States Patent [19]

Watabe

[11] Patent Number: 4,763,384

[45] Date of Patent: Aug. 16, 1988

[54] DOOR CLOSER AND CHECK

[75] Inventor: Takaji Watabe, Hirakata, Japan

[73] Assignee: Santo Industries Co., Ltd., Osaka, Japan

[21] Appl. No.: 916,318

[22] Filed: Oct. 7, 1986

[30] Foreign Application Priority Data

Apr. 30, 1986 [JP] Japan ..... 61-66310[U]

[51] Int. Cl.[4] ..... E05F 3/10

[52] U.S. Cl. ..... 16/53; 16/65

[58] Field of Search ..... 16/53, 60, 58, 65, DIG. 10, 16/DIG. 9, 57

[56] References Cited

U.S. PATENT DOCUMENTS 2,752,627 7/1956 Carlson ..... 16/DIG. 9

3,760,455 9/1973 Berry et al. ..... 16/53

*Primary Examiner*—Nicholas P. Godici

*Assistant Examiner*—G. M. Reid

*Attorney, Agent, or Firm*—Joseph W. Farley

[57] ABSTRACT

In a door closer, there are provided a vertical rotatable shaft associated with the rotation of a door through an arm, two cams installed integral with the shaft, an urging device for rotating the door in the closing direction through one of the cams and a cylinder device for braking the door during door closing operation through the other of the cams. Thus, the opening of the door is effected by overcoming the force of the urging device and hence the door can be opened lightly. When the door is released, the force of the urging device is transmitted to the one cam and then to the arm, so that the door can be automatically closed. During door closing operation, the cam surface of the other cam pushes the piston rod of the cylinder device, whereby the rotation of the other cam and hence the rotation of the shaft connected with the other cam are braked, avoiding severe shocks to the door.

7 Claims, 8 Drawing Sheets

DOOR CLOSER AND CHECK

FIELD OF THE INVENTION

The present invention relates to a door closer by which a door supported at one end widthwise thereof for rotation around a vertical axis can be automatically closed from its opened state.

BACKGROUND OF THE INVENTION

A conventional door closer of the type described comprises a door closer body having oil sealed therein, a piston housed in said door closer body and associated with the rotation of a door through an arm, a coil spring housed in said door closer body and urging said piston in the door closing direction, the arrangement being such that during door opening and closing operations, the oil pushed by the piston flows into a chamber disposed rearwardly as viewed in the direction of piston movement. Such a door closer is designed for fine adjustments so that the rate of flow of oil pushed by piston movement during door closing operation is lower than during door opening operation; thus, the door is braked during door closing operation. The aforesaid piston is connected to said arm through gears housed in the door closer body. More concretely, the rotary shaft of the gear is connected to the arm and the gear is meshed with the piston.

In the conventional door closer arranged in the manner described above, since the door closer body has gears and piston housed therein in their meshed state and has oil sealed therein and since fine adjustments are made so that the rate of flow of oil pushed by piston movement during door closing operation is lower than during door opening operation, the overall construction is complicated and the door closer body must be finished so that it is of sealed construction, thus offering a problem that the cost is high. Further, in the aforesaid conventional door closer, when opening the door, it is necessary to apply two forces, one required to open the door against the force of the coil spring and the other required to cause the piston to push the oil; thus, much force is required to open the door. Therefore, there has been a problem that the door opening load is high.

DISCLOSURE OF THE INVENTION

The present invention provides a door closer which eliminates the aforesaid conventional problems and which is inexpensive, wherein there is no need to seal oil in a door closer body, and a cylinder device for braking during door closing operation is small in size, the overall arrangement being simple, and the door can be opened lightly.

To achieve the aforesaid object, the invention provides a door closer comprising a door closer body adapted to be attached to the upper portion of the pivoted side of a door, a vertical rotatable shaft provided for the door closer body, said shaft being fixed at its upper end projecting upwardly of the door closer body to one end of an arm, the other end of the arm being rotatably supported by the door frame, two cams installed integral with said shaft in the door closer body, a slide case housed in the door closer body horizontally slidable and associated with the cam surface of one of the cams, means for urging said slide case toward the cam surface of the one of the cams to rotate the door in closing direction, and a cylinder device housed in the door closer body and having a piston rod adapted to abut at the front end thereof against the cam surface of the other of the cams. Thereby during door closing operation the piston rod is pushed by the cam surface to apply a brake.

In the above arrangement, when the door is opened, the force with which the cam surface of the other cam pushes the piston rod is removed. Therefore, it follows that the door opening operation is performed by overcoming only the force of said urging means. Thus, the door can be opened much more lightly by the present door closer than by the conventional door closer. Further, the opened door is automatically closed by said urging means, and in such closing operation the cam surface of the other cam pushes the front end of the piston rod of the cylinder device, thereby applying brake to avoid severe shock.

DESCRIPTION OF THE EMBODIMENTS

Figure 1:
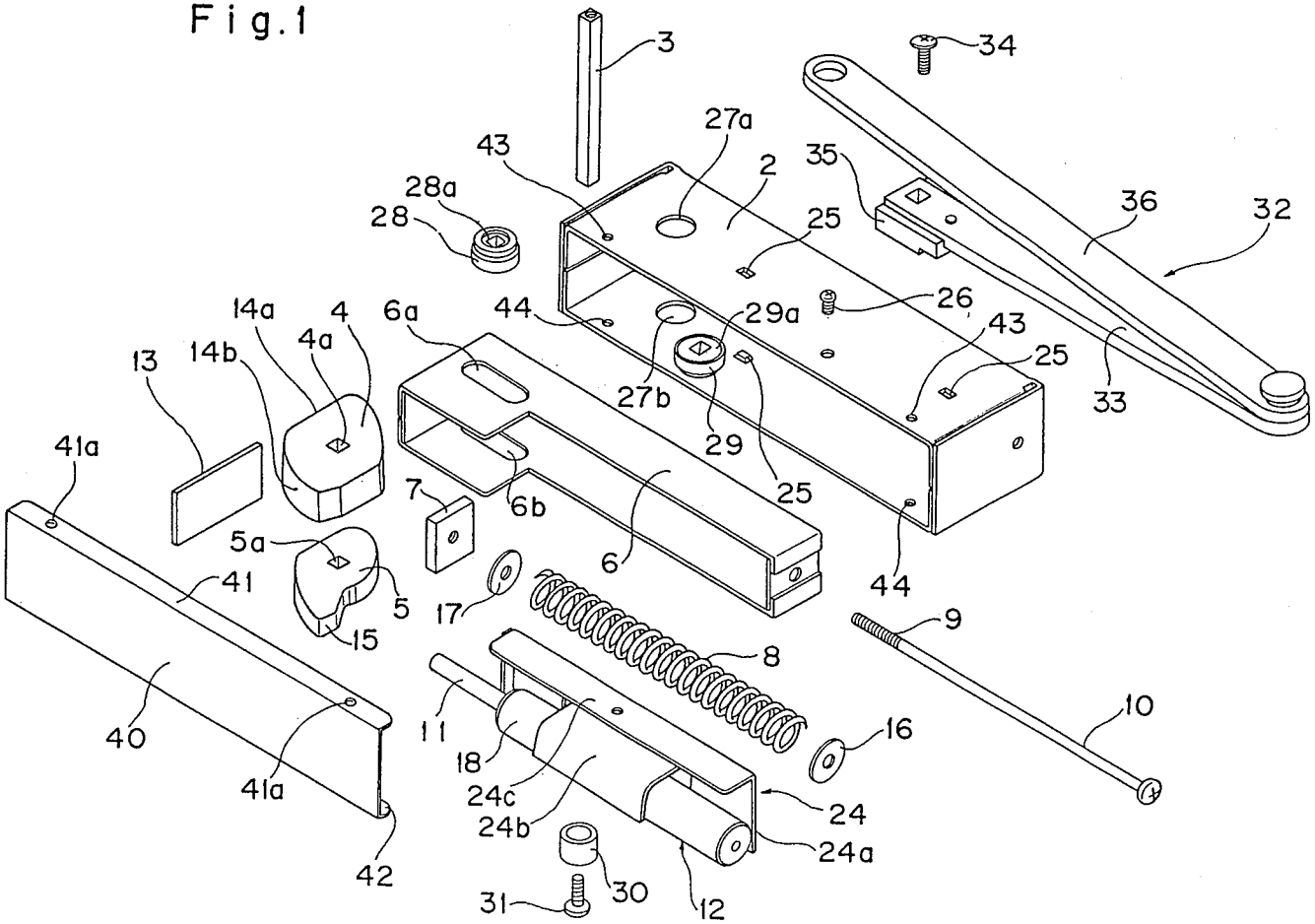
FIG. 1 is an exploded perspective view.
Figure 2:
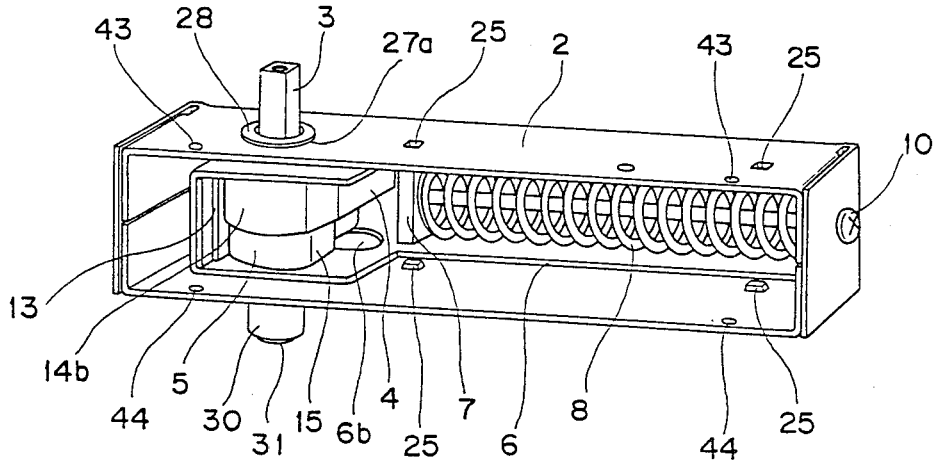
FIG. 2 and 3 are perspective views for explaining the order of assembly, illustrating the internal construction of a door closer body.
Figure 3:
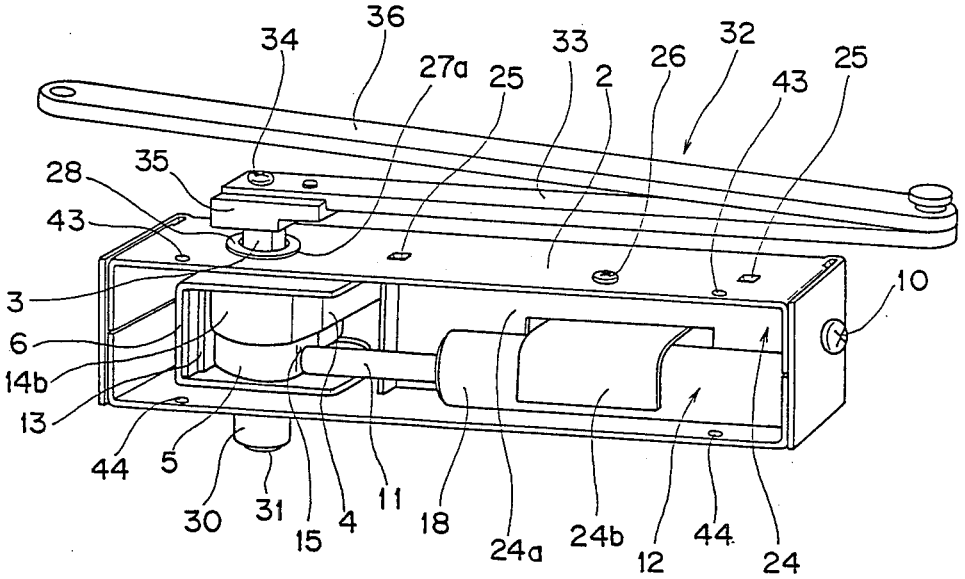

An embodiment of the invention will now be descsribed with reference to FIGS. 1 through 9.

In the drawings, the numeral 1 denotes a door (see FIG. 6) supported at one end widthwise thereof for rotation around a vertical axis to open and close a doorway, with a door closer body 2 attached to the upper portion of the door 1 adjacent one end widthwise thereof.

Housed in the door closer body 2 two cams 4 and 5 fixedly installed one above the other to a vertical rotatable shaft 3, a slide case 6 enclosing at one end thereof said cams 4 and 5 and associated at one end inner surface thereof with the upper cam 4 and having elongate openings **6*a* and 6*b* of suitable length extending lengthwise of said door closer body 2, a coil spring 8 associated at one end thereof with the other end inner surface of the slide case 6 and abutting at the other end thereof against a receiver 7, an adjusting bolt 10 inserted from the door closer body 2 into the other end of the slide case 6 and screwed at the front male screw portion 9 thereof into the receiver 7, said adjusting bolt, when rotated, moving the receiver 7 in the direction of expansion and contraction of the coil spring 8 so as to adjust the force of the coil spring 8, and a cylinder device 12 having a piston rod 11 which can be pressed at the front end thereof against the lower cam 5**.

More particularly, said shaft 3 is a square shaft and extends vertically through the elongate openings **6*a* and 6*b* of the slide case 6, while the cams 4 and 5 are formed with square holes 4*a* and 5*a* for receiving said shaft 3**.

The cams 4 and 5 are fitted at their square holes 4*a* and 5*a* on the shaft 3 and thereby fixed thereon. Of said cams 4 and 5, the upper cam 4 is provided with a cam surface in contact with a plate 13 inserted between it and the inner surface of one end of the slide case 6 when the door 1 is in its closed state, and an arcuate surface 14*b* contiguous with said flat surface 14*a* and having its radius gradually increased from the boundary between it and the flat surface 14*a*, said arcuate surface being adapted to contact the plate 13 inserted between it and the inner surface of one end of the slide case 6 when the door 1 is rotated. The lower cam 5 has a cam surface 15 adapted to press the front end of the piston rod 11 of the cylinder device 12 when the door 1 is closed to the position at the door opening angle of about 45 degrees during door closing operation.

The aforesaid coil spring 8 contacts at its both ends with the other inner surface of one end of the slide case 6 and the receiver 7 respectively through washers 16 and 17, while the adjusting bolt 10 for adjusting the force of the coil spring 8 extends through said coil spring 8.

The aforesaid cylinder device 12 is internally provided with another coil spring 20 for urging a piston 19 toward the lower cam 5 and has oil sealed therein, with a small clearance 21 defined between the outer peripheral surface of the piston 19 and the inner surface of the cylinder device body 18 so that oil being pushed by the movement of the piston 19 flows into a chamber disposed rearwardly as viewed in the direction of movement of the piston 19. The amount of oil flowing through the clearance 21 is constant, and in order to increase the flow rate of oil during the movement of the piston 19 in the direction in which the piston rod 11 extends in the direction of the lower cam 5, there is formed for oil a path 22 in the piston 19 and the piston rod 11, which establishes communication between both chambers in the cylinder device body 18. Installed in the path 22 is a ball valve 23 which is adapted to open the path 22 by being pushed by oil flowing into the chamber disposed rearwardly as viewed in the direction of movement of the piston 19 when the piston 19 is moved toward the lower cam 5. The ball valve 23 is adapted to close the path 22 by being pushed by the oil contained in a chamber disposed forwardly as viewed in the direction of movement of the piston 19 when the front end of piston rod 11 is pushed by the cam surface 15 of the lower cam 5.

Attachment of the cylinder device 12 of such construction to the door closer body 2 is effected by holding the cylinder device 12 between the vertical flat plate portion 24*a* and arcuate plate portion 24*b* of a support member 24, inserting the support member 24 into the door closer body 2 through its front opening until the back of the flat plate portion 24*a* of the support member 24 abuts against projections 25 formed on the inner upper and lower surfaces of the door closer body 2, and fixing the upper end plate portion 24*c* of the support member 24 to the upper end of the door closer body 2 by a set screw 26.

To support the shaft 3 by the door closer body 2, the shaft 3 is inserted in bearings 28*a* and 29*a* rotatably installed in rings 28 and 29 fitted in holes 27*a* and 27*b* formed in the upper and lower walls of the door closer body 2. The cams 4 and 5 are rotatable integral with the shaft 3. The lower end of the shaft 3 projecting downward beyond the lower bearing 29*a* has a cap 30 fitted thereon from below to prevent the shaft 3 from being pulled off upward, said cap 30 being fixed in position by a set screw 31 screwed from below into a threaded hole in the shaft 3 through the cap 30. The upper end of the shaft 3 upwardly projecting through the upper bearing 28*a* has one end of a first arm 33 of a double arm device 32 fitted thereon from above, one end of the first arm 33 being fixed in position by a set screw 34 screwed from above into a threaded hole in the upper end of the shaft 3 through the first arm 33. One end of the first arm 33 has a reinforcing member 35 attached to the lower side thereof to reinforce said one end. One end of a second arm 36 of said double arm device 32 is pivotally supported through a bracket 38 and a shaft 39 on the upper end of the door frame 37 in which the door is installed.

Figure 4:
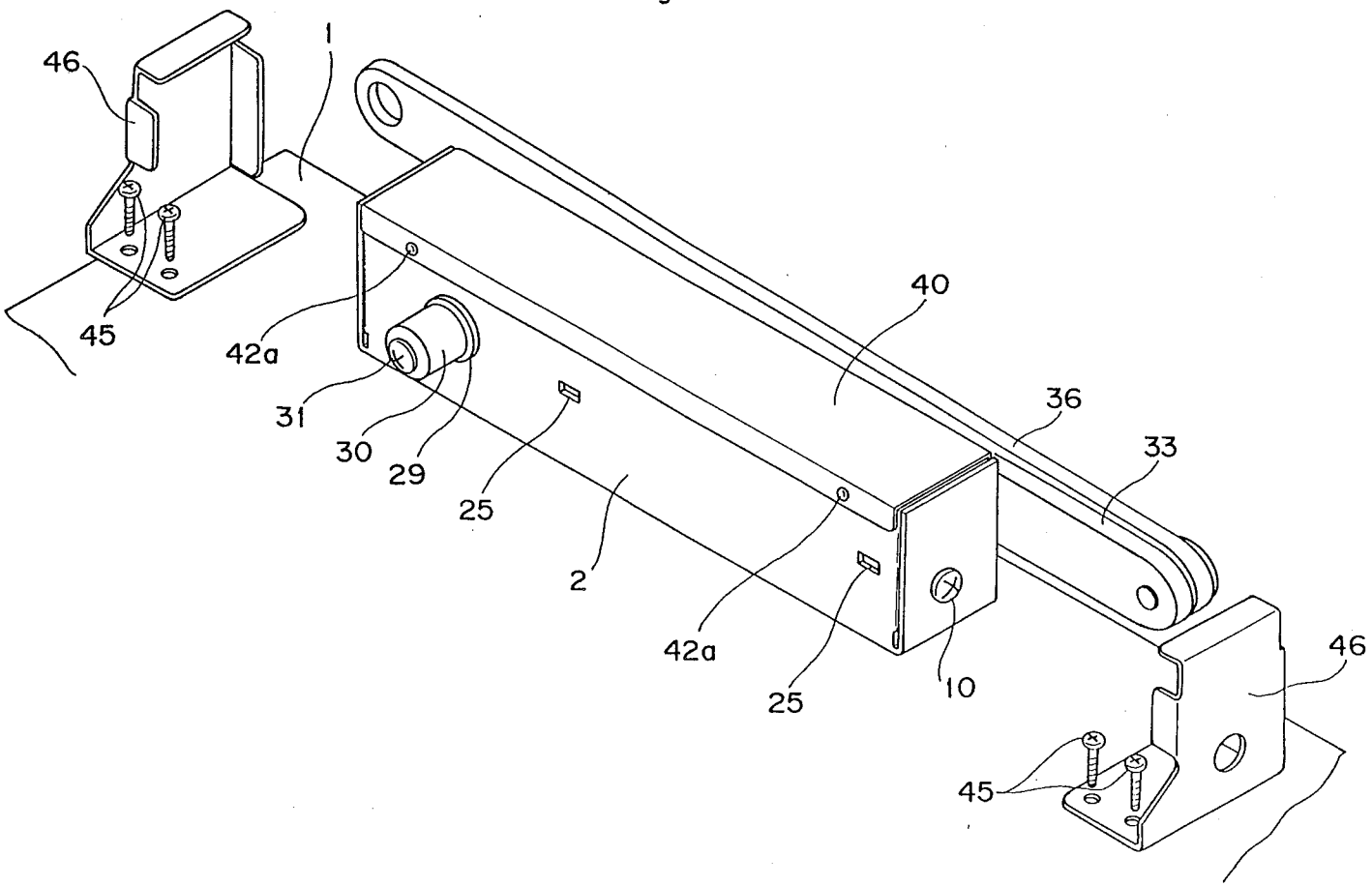
FIG. 4 is an enlarged perspective view showing the state existing before the door closer body is installed in position.
Figure 5:
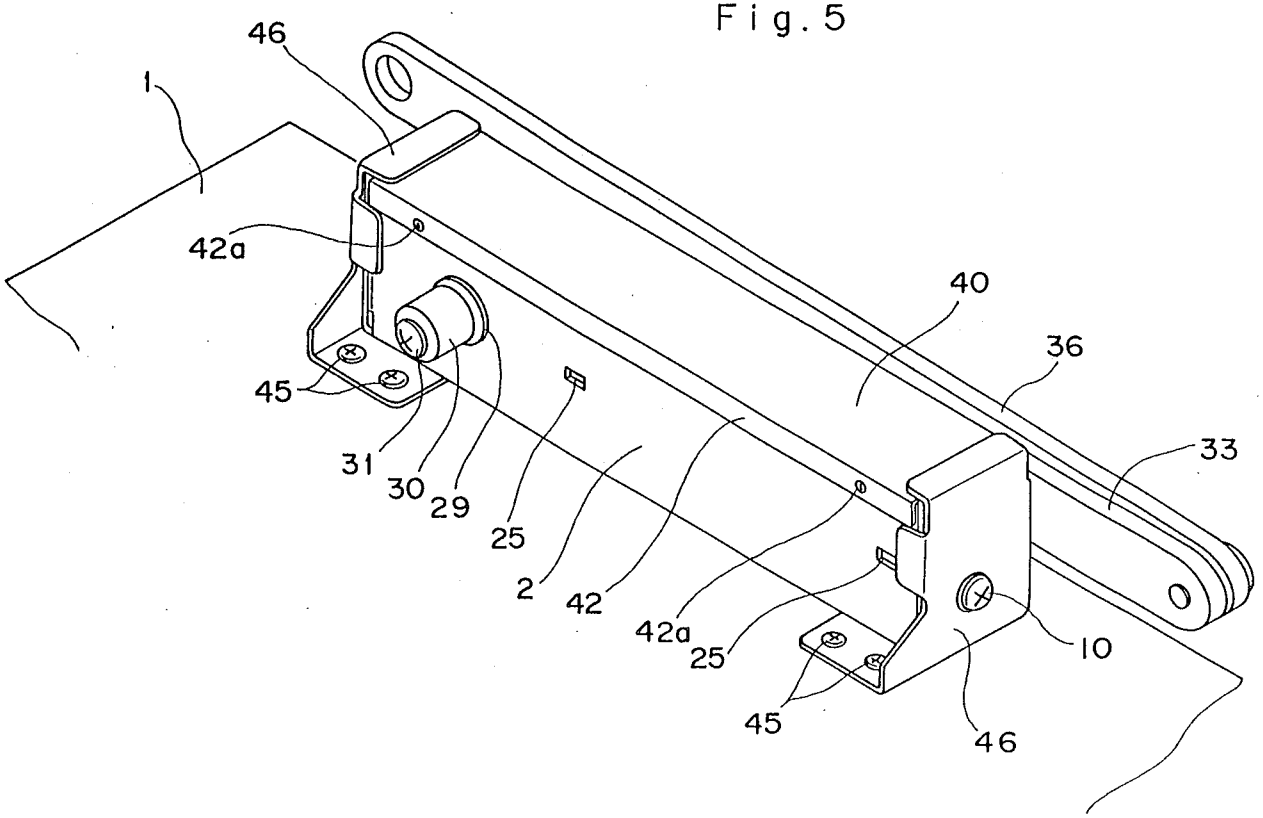
FIG. 5 is an enlarged perspective view showing the state of the door closer body attached to a door.

The front opening of the door closer body 2 is closed by a cover plate 40 having upper and lower bent plate portions 41 and 42 adapted to hold the upper and lower front portions of the door closer body 2 therebetween, said bent portions 41 and 42 having projections 41*a* and 42*a* formed thereon for fitting into holes 43 and 44 formed in the door closer body 2, whereby the cover plate 40 is held in position. The door closer body 2 having the cover plate 40 attached thereto in this manner is attached to the door by brackets 46, as shown in FIGS. 4 and 5, which are adapted to hold the longitudinal opposite ends of the door closer body 2 and are fixed to the upper portion of the door 1 adjacent one end widthwise thereof by set screws 45.

Figure 6:
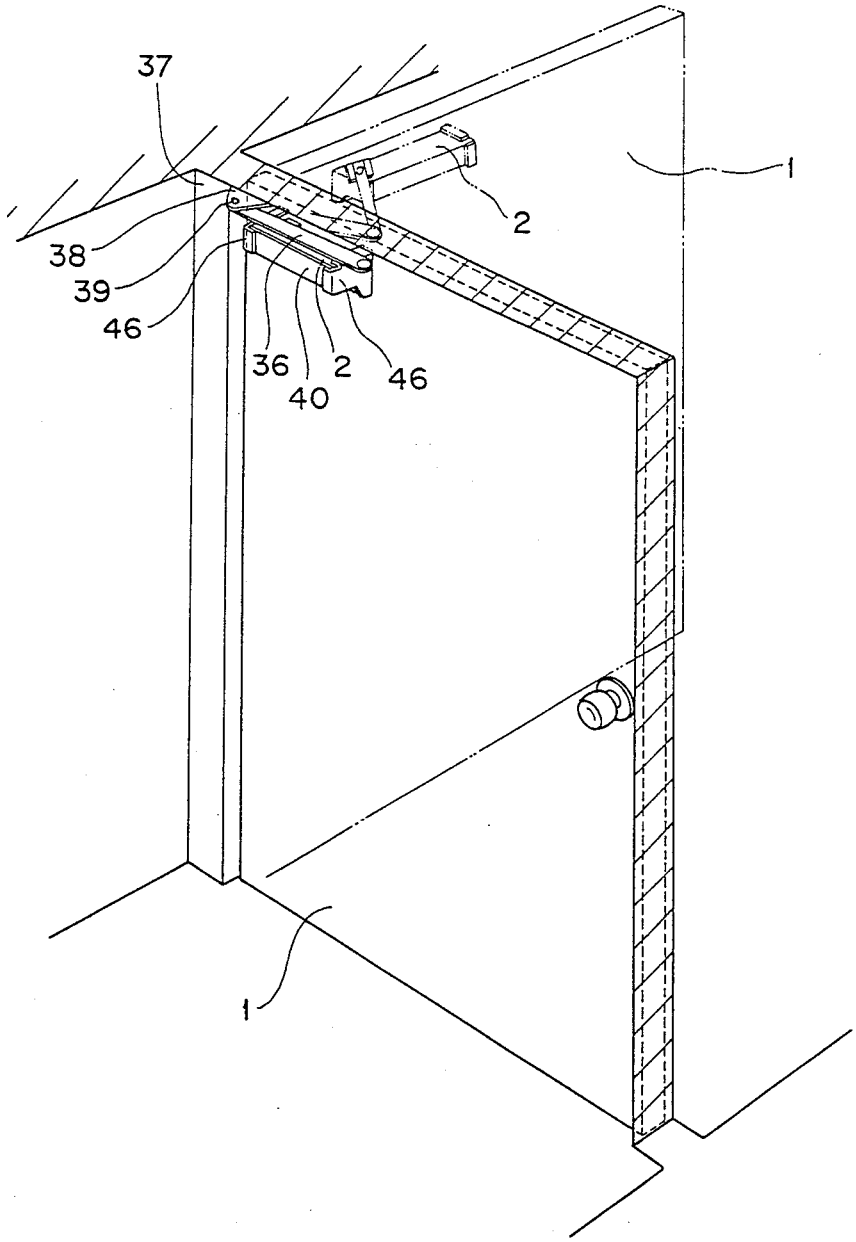
FIG. 6 is a complete perspective view showing the state of the door closer body attached to the upper portion of a door.
Figure 7:
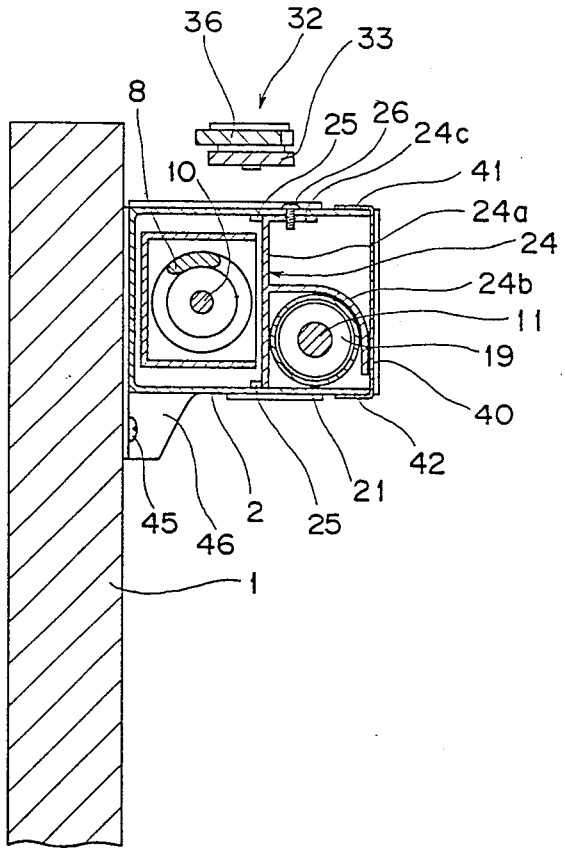
FIG. 7 is a cross sectional view of the door closer body.
Figure 8:
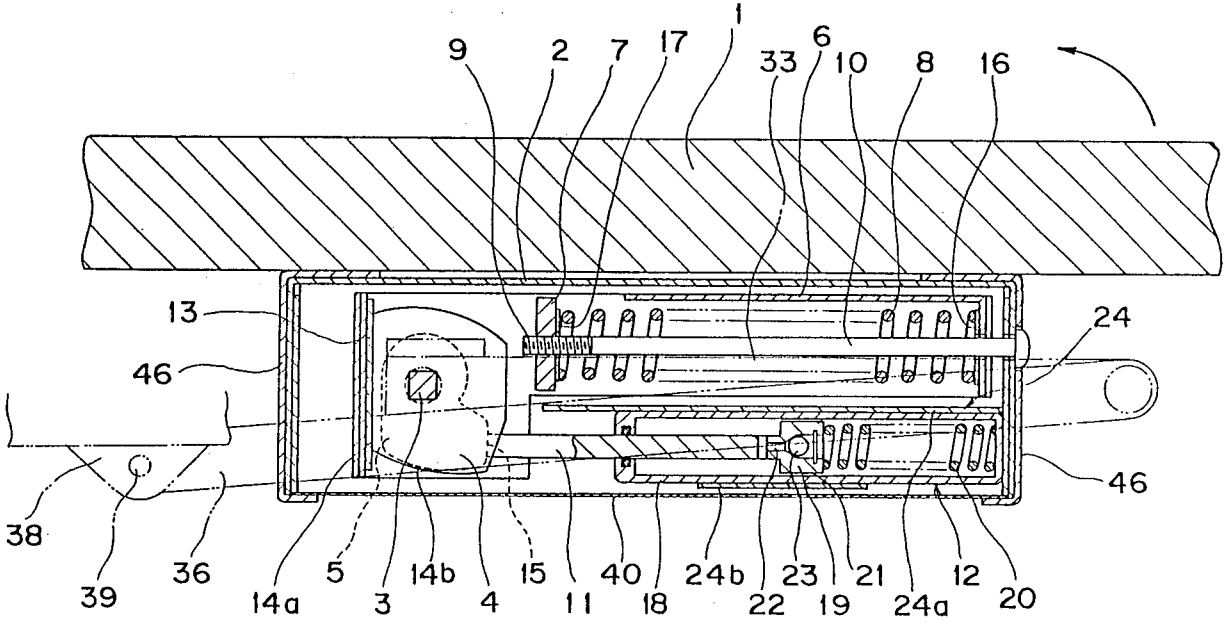
FIG. 8 and 9 are longitudinal sectional views of the door closer body for explaining the operation.
Figure 9:
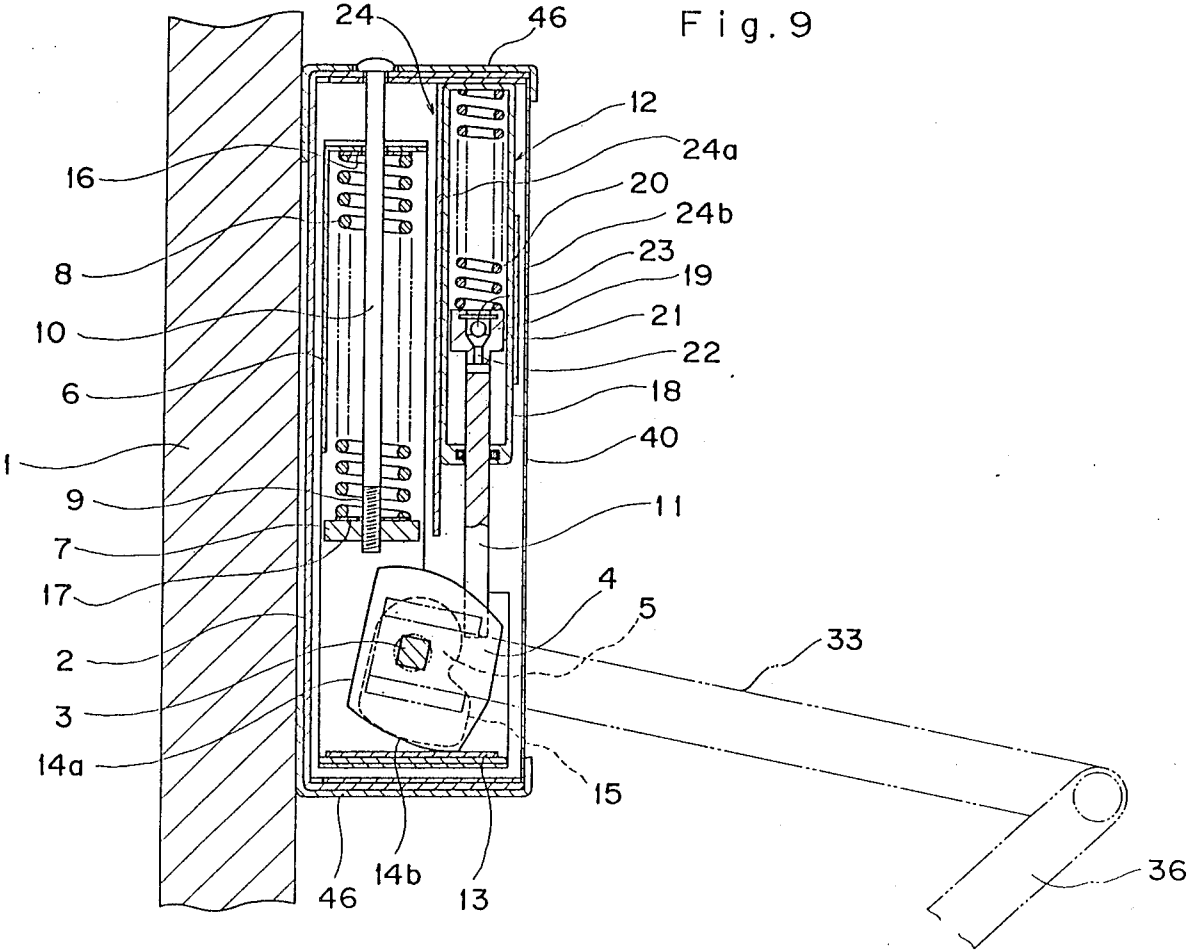

The operation of the door closer of the above construction will now be described. The door closer, as shown in FIG. 6, is attached to the upper portion of the door 1 adjacent one end widthwise thereof, thus, by opening the door 1 as shown in phantom lines in FIG. 6, the shaft 3 connected to the first arm 33 of the double arm device 32 is rotated, so that the cams 4 and 5 mounted thereon are also rotated. At this time, the arcuate surface 14*b* of the upper cam 4 is associated with inner surface of one end of the slide case 6 to move the slide case 6 in such a direction that the coil spring 8 is compressed. With the door opened to the maximum extent (about 90 degrees), the portion of the arcuate surface 14*b* of the cam 4 adjacent the maximum radius thereof is associated with inner surface of one end of the slide case 6 and the restoring force of the coil spring 8 is transmitted through the shaft 3, so that the door 1 is urged in the closing direction through the double arm device 32 interposed between said shaft 3 and the door frame 37.

Therefore, when the opened door 1 is released, the door 1 is automatically closed. Meanwhile, when the door 1 is opened the the maximum extent, the cam surface 15 of the lower cam 5 is spaced from the front end of the piston rod 11, and it does not happen until the door 1 is closed at the door opening angle of about 45 degrees that the cam surface 15 abuts against the front end of the piston rod 11. Then, in the subsequent closing operation, the cam surface 15 continuously pushes the front end of the piston rod 11. When the piston rod 11 is pushed by the cam surface 15, the oil in the chamber disposed forwardly as viewed in the direction of movement of the piston rod 11 can escape only through the small clearance 21 between the outer peripheral surface of the piston 19 and the inner surface of the cylinder device body 18, the rate of flow of the oil through said clearance 21 being so low that the rate of the piston movement is low, thus, the lower cam 5 can be braked. Therefore, the shaft 3 integral with the lower cam 5 is also braked and so is the door 1. Thus, when the door 1 is further closed from the position at about 45 degrees, it can be closed at low speed; hence severe closing shock to the door frame 37 can be avoided.

When the door 1 is being opened, the force charged on the piston rod 11 by the lower cam is removed as the lower cam 5 is rotated, and the piston rod 11 is projected toward the cam 5 as the piston 19 is pushed by the coil spring 20 in the cylinder device 12. At this time, the oil in the chamber disposed forwardly as viewed in the direction of movement of the piston 19 quickly flows through the clearance 21 and the path 22 into another chamber disposed rearwardly as viewed in the direction of movement of the piston 19. Therefore, the projecting speed of the piston rod 11 is high, conforming to the opening movement of the door 1. During door opening operation, since the force with which the cam surface 15 of the lower cam 5 has pressed the piston rod 11 is removed, the opening movement of the door 1 is effected by overcoming the force of the coil spring 8, and the door can be opened with a small force as compared with the conventional door closer in which two forces are required, one for opening the door against the force of the coil spring and other for pushing the oil through the piston.

Further, by rotating the aforesaid adjusting bolt 10 by a screw driver, said receiver 7 is moved to adjust the amount of compression of the coil spring 8, whereby the closing speed of the door 1 can be adjusted.

What is claimed is:

1. A door closer comprising a door closer body adapted to be attached to the upper portion of the pivoted side of a door, a vertical shaft rotatably supported by the door closer body, said shaft having an upper end projecting upwardly of the door closer body and fixed to one end of an arm means, the other end of the arm means being adapted to be rotatably supported by the door frame, two cams installed on said shaft in the door closer body, said cams being adapted to rotate together with the shaft, a slide case horizontally slidably housed in the door closer body for movement transverse to the axis of said shaft, said slide case having one inner end surface operably associated with the cam surface of one of the cams, means for urging said slide case toward the cam surface of said one of the cams to rotate the door in a closing direction, said slide case encasing a majority of said one of the cams and said means for urging said slide case, and a cylinder device housed in the door closer body and having a piston rod adapted to abut at the free end thereof against the cam surface of the other of the cams whereby during door closing operation the piston rod is pushed by the cam surface of the other of said cams to apply a brake.

2. a door closer as set forth in claim 1 wherein the cam surface of said one of the cams comprises a flat surface extending parallel to said one inner end surface of said slide case in the closed position of the door closer, and an arcuate surface extending from said flat surface at a gradually increasing radius.

3. A door closer as set forth in claim 1, wherein said urging means is a coil spring, said slide case having an other inner end surface opposite to said one inner end surface, one end of said coil spring being operatively associated said other inner end surface and the other end of said coil spring acting against a receiver carried by said door closer body.

4. A door closer as set forth in claim 3, wherein said receiver is carried by an adjusting bolt engaged with the door closer body and extending through said coil spring, the front threaded portion of said adjusting bolt being screwed in said receiver, the arrangement being such that by rotating said adjusting bolt, the receiver is moved in the direction of expansion and contraction of said coil spring to adjust the spring force.

5. A door closer as set forth in claim 3 wherein said one inner end surface of said slide case is disposed to one side of said shaft and adjacent to said one of the cams, and said other inner end surface of said slide case is disposed to the opposite side of said shaft, said slide case being provided with elongated openings through which said shaft extends and which position said slide case relative thereto.

6. A door closer as set forth in claim 1, wherein the cam surface of the other of said cams is spaced from the free end of the piston rod of said cylinder device when the door is opened to a maximum extent, and the cam surface of the other of the cams is adpated to contact the free end of the piston rod when the door is closed to an opening angle of about 45 degrees.

7. A door closer as set forth in claim 1, wherein said cylinder device is internally provided with a piston and a piston spring for urging the piston toward the other of the cams and has oil sealed therein, and there is formed for oil a communication path in the piston and the piston rod so that during piston movement the rate of flow of oil moving into a chamber disposed rearwardly as viewed in the direction of movement of the piston may be increased when the piston is moved toward said other cam by the force of the piston spring.

* * * * *

UNITED STATES PATENT AND TRADEMARK OFFICE

CERTIFICATE OF CORRECTION

PATENT NO. : 4,763,384

DATED : August 16, 1988

INVENTOR(S) : Takaji Watabe

It is certified that error appears in the above—identified patent and that said Letters Patent is hereby corrected as shown below:

Column 5, lines 4 and 5, "charged on" should read --applied to--

Column 6, line 37, "adpated" should read --adapted--

Signed and Sealed this

Sixth Day of December, 1988

*Attest:*

DONALD J. QUIGG

*Attesting Officer*

*Commissioner of Patents and Trademarks*